United States Patent [19]

Odera

[11] Patent Number: 4,937,531

[45] Date of Patent: Jun. 26, 1990

[54] EXTERNAL ION INJECTION APPARATUS FOR A CYCLOTRON

[75] Inventor: Masatoshi Odera, Tokyo, Japan

[73] Assignee: Sumitomo Heavy Industries, Ltd., Tokyo, Japan

[21] Appl. No.: 241,307

[22] Filed: Sep. 7, 1988

[30] Foreign Application Priority Data

Sep. 24, 1987 [JP] Japan ..... 62-237085

[51] Int. Cl.[5] ..... H05H 13/00

[52] U.S. Cl. ..... 328/234; 313/62; 313/359.1

[58] Field of Search ..... 313/62, 359.1; 328/234, 328/233

[56] References Cited

U.S. PATENT DOCUMENTS 4,789,839 12/1988 Morris ..... 328/234

*Primary Examiner*—Donald J. Yusko
*Assistant Examiner*—Michael Horabik
*Attorney, Agent, or Firm*—Burns, Doane, Swecker & Mathis

[57] ABSTRACT

The external ion injection apparatus for a cyclotron is improved so as to be applicable to a small-sized cyclotron and yet capable of accelerating a large-intensity ion beam. The improvements reside in the provision of an ion source disposed externally of a cyclotron, a first D.C. high voltage generator coupled to the ion source for generating a first D.C. high voltage to inject ions produced by the ion source as an incident ion beam with a predetermined acceleration into the cyclotron along a magnetic midplane thereof, a second D.C. high voltage generator for generating a second D.C. high voltage of the same polarity as the first D.C. high voltage, and a beam guiding electrode group arranged within the cyclotron and applied with the second D.C. high voltage for leading the incident ion beam towards the central portion of the magnetic poles of the cyclotron along a repeated semicircle orbit.

4 Claims, 2 Drawing Sheets

EXTERNAL ION INJECTION APPARATUS FOR A CYCLOTRON

BACKGROUND OF THE INVENTION

1. Field of the Invention:

The present invention relates to an apparatus for externally injecting ions into a cyclotron.

2. Description of the Prior Art:

Generally, in a cyclotron, an ion source is disposed at the center of magnetic poles. Therefore, due to the fact that a degree of vacuum is deteriorated by discharge of gas from the ion source and an orbit of an ion beam is varied as a result of change of operation parameters of the ion source, acceleration and take-out of a large-intensity ion beam are difficult. In order to obviate this difficulty, heretofore, various methods for externally injecting ions into a cyclotron have been proposed, as described in the following:

(1) Perpendicular injection method

This method is such that a hole is drilled at the center of the magnetic pole, then an ion beam is injected in perpendicular to an acceleration orbit plane along which the ion beam is to be accelerated (since this plane is present on a midplane of a D.C. magnetic field, it is also called "magnetic midplane"), and when the ion beam has approached the acceleration orbit plane, the direction of the ion beam is changed by means of an electric field to be driven into the acceleration orbit plane. For the purpose of changing the direction of the ion beam, various implements such as an extracting electrode and a fine adjustment therefor are disposed at the central portion of the magnetic poles.

Except for the above-mentioned perpendicular injection method, the methods described hereunder are methods of injecting an ion beam into a cyclotron within an acceleration orbit plane (horizontal plane).

(2) Method of straightly injecting ions by offsetting the force exerted upon the ion by a magnetic field with an electric field This method was tried at the Saclay Research Laboratory in France, and about in 1968 they succeeded in acceleration of a polarized proton beam by means of a cyclotron for the first time in the world. In this method, it is necessary that a high voltage is used in a narrow magnetic pole gap and the electric field intensity is varied according to variation of the magnetic field along the orbit.

(3) Gladyshev method

This method is called so because about in 1967, Gladyshev of USSR announced his success. Thereafter, success is also reported by making use of the cyclotron at Delft in Holland. According to this method, an ion beam is made to perform circular motion many times until it reaches the central portion of magnetic poles as it travels along the boundary between a hill and a valley of a magnetic field in an AVF cyclotron.

(4) Neutralized particle injection method

This method is such that initially an ion beam is accelerated under the condition of ions, after the traveling direction of ions has been determined by means of an electromagnetic field the ions are made to pass through a gaseous medium to be neutralized, then they are made to travel straightly by avoiding the influence of a magnetic field and are made to pass through a thin film stripper disposed at the central portion of the magnetic poles to be reionized, and they are accelerated. This method was tried in a cyclotron in Yugoslavia.

(5) Method of modifying a structure of a cyclotron per se so as to be adapted for horizontal injection A separated-sector type cyclotron has the modified structure. The portion of a valley in the conventional AVF cyclotron is removed and separated into individual magnets, and thereby the magnetic field strength at the valley is made to be zero. An externally injected ion beam would travel straightly through the valley portion, then it changes a traveling direction at the central portion of the magnetic field, and it is accelerated. Through this method, acceleration of a high-energy beam having a large intensity, which was impossible with the AVF cyclotron, becomes possible.

However, the above-mentioned methods in the prior art have the disadvantages as will be described in the following:

At first, in the method (1) above, since the hole at the center of the magnetic pole through which an ion beam passes has to be small in diameter and hence evacuation through this hole is difficult, it is impossible to attain a high vacuum. Hence, there exists the inconvenience that electric charge of a heavy ion or a negative hydrogen ion would change. In addition, it is difficult to design an electrode group for changing the direction of an ion beam because the environmental magnetic field is varied due to the influence of the hole in the magnetic pole, and unless the gap space between the magnetic poles is large, it is impossible to dispose the electrode group therein. Therefore, this method (1) above can be employed only in a large-sized cyclotron.

In the method (2) above, a high voltage is used in a narrow magnetic pole gap, and since the direction of the ion beam would change unless the electric field intensity is finely adjusted, this method is disadvantageous in that loss of an ion beam would become large due to generation of electric discharge or presence of small field error in the magnet. Accordingly, at present, this method (2) is not employed.

In the method (3) above, as the ion beam performs circular motion many times until it reaches the central portion of magnetic poles, it is inevitable that the ion beam would diverge before it reaches the central portion of magnetic poles and hence the proportion of attaining incidence to the acceleration orbit would be decreased. In addition, this method is disadvantageous in that even with a slight change of the magnetic field strength, the orbit of the ion beam in the proximity of the central portion of magnetic poles would change largely, and it takes much time for readjusting the magnetic field strength. Consequently, this method is also not employed at present.

In the method (4) above, there results a very small product of a probability in the electric charge transformation process from ions to neutralized particles and another probability in the electric charge transformation process from the neutral particles to ions. In addition, particles would scatter at the respective transforming sections and an ion beam would diverge, and hence a strength of the beam which can be accelerated would become extremely small. Accordingly, this method is also not used at present.

In the method (5) above, the number of magnets is so many that the weight of the cyclotron would become large as compared to an AVF cyclotron of the same energy. In addition, high precision is required for manufacture and installation, and hence a cost would become high. Accordingly, this is a method suitable for a large-sized high-energy cyclotron.

As described above, an external ion injection method is not used for a small-sized AVF cyclotron at present. Although the perpendicular injection method is employed in a large-sized AVF cyclotron, there exist various problems as mentioned above, and the method has not been successfully employed in injection of a large-intensity beam to a standard type AVF cyclotron.

SUMMARY OF THE INVENTION

It is therefore an object of the present invention to provide a convenient external ion injection apparatus that is applicable even to a small-sized cyclotron and that can accelerate a large-intensity ion beam.

According to the present invention, there is provided an external ion injection apparatus for a cyclotron comprising an ion source disposed externally of a cyclotron for producing ions, a first D.C. high voltage generator coupled to the ion source for generating a first D.C. high voltage to be used for injecting the ions produced by the ion source as an incident ion beam with a predetermined acceleration into the cyclotron along a magnetic midplane thereof, a second D.C. high voltage generator for generating a second D.C. high voltage of the same polarity as the first D.C. high voltage, and a beam guiding electrode group arranged within the cyclotron to continuously extend in a straight line between an outer circumferential edge of the cyclotron and a central portion of the cyclotron and applied with the second D.C. high voltage for leading the incident ion beam towards the central portion of the magnetic poles of the cyclotron along a repeated semicircle orbit.

In operation, the ions produced by the ion source are injected into the cyclotron as an incident ion beam with a predetermined acceleration along a magnetic midplane thereof, by the first D.C. high voltage generated by the first D.C. high voltage generator. This incident ion beam is led towards the central portion of the magnetic poles of the cyclotron along a repeated semicircle orbit under the action of the beam guiding electrode group applied with the second D.C. high voltage fed from the second D.C. high voltage generator.

According to the present invention, since there is no need to dispose an ion source at the central portion of magnetic poles as is the case with the cyclotron in the prior art, the interior of the cyclotron can be maintained at a higher degree of vacuum. As a result, even the ions liable to change in electric charge such as negative ions or heavy ions would not be subjected to change of electric charge, and acceleration of a large-intensity ion beam is possible. Moreover, since a degree of vacuum is high and electric discharge would hardly occur, it is also possible to use a high dee voltage.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

In the following, a preferred embodiment of the present invention will be described with reference to the accompanying drawings.

Figure 1:
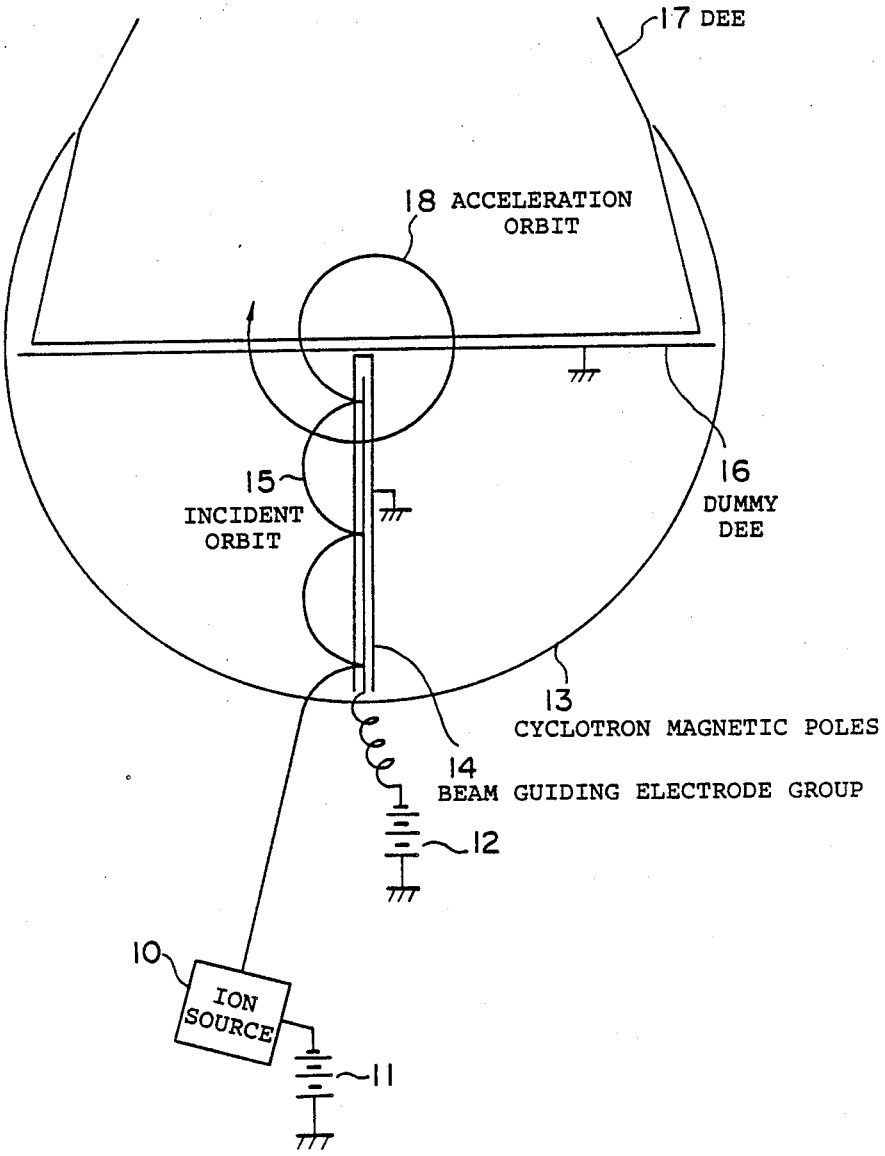
FIG. 1 is a schematic plan view showing a general construction of an external ion injection apparatus for a cyclotron according to one preferred embodiment of the present invention for a case of injection of the negatively charged ions.

Referring now to FIG. 1, an external ion injection apparatus according to a preferred embodiment of the present invention includes an ion source 10 disposed externally of a main body of a cyclotron. To this ion source 10 is coupled a first D.C. high voltage generator 11 which accelerates ions produced by the ion source 10 with a first D.C. high voltage (an accelerating voltage) to inject them towards cyclotron magnetic poles 13 as an incident ion beam. At this time, the incident ion beam is injected along the magnetic midplane of the cyclotron as shown in the figure.

Within the cyclotron is arranged a beam guiding electrode group 14 coupled to a second D.C. high voltage generator 12 as shown in the same figure. The beam guiding electrode group 14 extends in a straight line between the cyclotron's circumferential edge and its midportion. This beam guiding electrode group 14 makes the incident ion beam repeat the motion of decelerating in a short distance and then accelerating again under the action of a second D.C. high voltage (a repeller voltage) applied from the second D.C. high voltage generator 12, and as shown in FIG. 1, it leads the incident ion beam towards the central portion of the magnetic poles of the cyclotron along a repeated semicircle orbit (a pseudo-cycloid orbit) which forms an incident orbit 15.

As shown in FIG. 1, the ion beam arrived at the central portion of the magnetic poles can pass through a dummy dee 16 at a position and an angle adapted for an initial acceleration orbit by appropriately selecting an incident angle of the incident ion beam, relative positioning of the beam guiding electrode group 14 and the accelerating and repeller voltages, and then can be accelerated by a dee 17. Thereafter, the ion beam increases its energy while moving along an acceleration orbit 18, resulting in increase of the radius of curvature of the acceleration orbit 18, and finally it is taken out externally of the magnetic field by means of a deflector (not shown) provided in the vicinity of the periphery of the dee 17.

The above-mentioned process is effected regardless of the polarity (positive or negative) of charge of the ions produced by the ion source 10. As a matter of course, in the case where the polarity of charge of the ions is changed, it is necessary to change the polarities of the electric field and the magnetic field.

It is to be noted that in the illustrated embodiment, the beam guiding electrode group 14 extends between an outer circumferential edge of the cyclotron and the central portion of the magnetic poles and is arranged at right angles to the dummy dee 16, as shown in FIG. 1. However, other angular arrangements are possible to be used according to the configurations desired inside the acceleration chamber.

Figure 2:
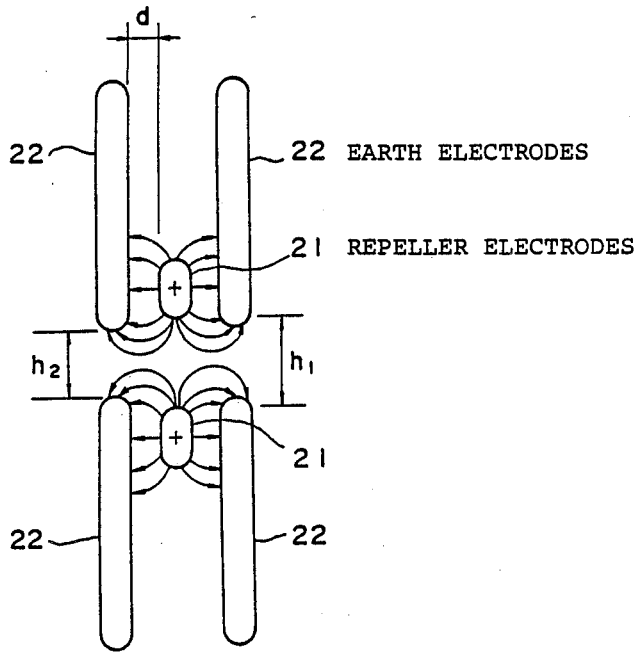
FIG. 2 is a vertical cross-section view showing a construction of a beam guiding electrode group in FIG. 1.

Referring to FIG. 2, the beam guiding electrode group 14 shown in FIG. 1 consists of a combination of repeller electrodes 21 applied with the repeller voltage from the second D.C. high voltage generator 12 for decelerating or accelerating the incident ion beam, and earth electrodes 22 disposed closely to the repeller electrodes 21 for limiting a range of an electric field generated by the repeller electrodes 21. In this example, the case of injection of positive ions is supposed, and the repeller voltage is assumed to be positive.

More particularly, the repeller electrodes 21 consist of two electrode pieces arranged as separated by a first distance $h_1$ from each other via the magnetic midplane of the cyclotron. Also, the earth electrodes 22 consist of four electrode pieces opposed to one another with the repeller electrodes 21 placed therebetween and arranged as separated by a second distance $h_2$ from one another via the magnetic midplane of the cyclotron. The reason why the repeller electrodes 21 are separated from each other is because it is intended to allow the accelerated ion beam accelerated by the dee 17 to pass therethrough, and the separation of the earth electrodes 22 is for the purpose of allowing the incident ion beam and the accelerated ion beam to pass therethrough. In addition, the first distance $h_1$ is selected longer than the second distance $h_2$ as shown in FIG. 2 so that the accelerated ion beam may not collide with the repeller electrodes 21.

Here, the second distance $h_2$ is determined by the vertical amplitude of the acceleration orbit 18 of the accelerated ion beam moving within the cyclotron. In other words, the second distance $h_2$ need not be made broader than a slit width of the dummy dee 16. It is more preferable to cool the earth electrodes 22. In addition, the distance d between a repeller electrode 21 and an earth electrode 22 should be preferably made narrow for the purpose of making a return (reverse) points in the repeated semicircle orbit 15 of the incident ion beam to be definite. However, this distance d is determined on the basis of the ratio with respect to the first distance $h_1$ of the repeller electrode 21.

While the earth electrodes 22 are shown as separated from each other in FIG. 2, the tip ends of the separated earth electrodes 22 on the left and on the right or at the above and at the below could be connected with each other to make them mechanically rigid or to facilitate cooling of them, paying attention to a discharge withstand voltage.

For the first and second D.C. high voltage generators 11 and 12, a same voltage source could be employed. However, as the effective accelerating or decelerating potential would vary depending upon the ratio between the distances $h_1$ and d in FIG. 2, for the purpose of compensating for that variation and fine adjustment of the repeated semicircle orbit 15, it is desirable to use separate voltage sources as the first and second D.C. high voltage generators 11 and 12. For the second D.C. high voltage generator 12, a voltage source having a small current capacity could be employed.

The accelerating voltage (incident voltage) for accelerating the ions produced by the ion source 10 should be preferably as high as possible. This is because a diameter of a semicircle of the repeated semicircle orbit 15 becomes large, hence a small number of steps of acceleration and deceleration before arrival at the central portion of the magnetic poles can suffice, and transformation from the repeated semicircle orbit 15 to the acceleration orbit 18 at the central portion of the magnetic poles also becomes easy. However, since the repeller voltage has an upper limit due to electric discharge in the magnetic pole gap, the accelerating voltage cannot be arbitrarily enlarged. The repeller voltage could be a voltage of the same order as or a little higher than the voltage applied to the deflector for taking out the ion beam from the cyclotron. Furthermore, if the beam guiding electrode group 14 can be disposed in the portion of a valley of the magnet in the cyclotron, the distance in the vertical direction along which electric discharge is liable to occur, can be made long, and the repeller voltage also can be selected at a somewhat high voltage. In this case, since the portion of the valley where a magnetic field is weak is used for incidence of an ion beam, the diameter of the semicircle of the repeated semicircle orbit 15 can be made large, and so, it is favorable.

However, in order to allow an incident ion beam to arrive at the central portion of the magnetic poles, it is necessary that a focusing member is present so that the incident ion beam may not diverge and may not be lost in the midway of the incident orbit. The external ion injection apparatus according to the present invention fulfils this condition, too, as will be described in detail in the following.

It is known that circular motion of an ion beam within a uniform vertical magnetic field would converge after every 180° rotation within the horizontal plane. In the external ion injection apparatus according to the present invention, since acceleration and deceleration of an incident ion beam are effected concentratedly at these convergent points and then the converged ion beam is sent out along the next semicircle orbit, divergence of the incident ion beam within the horizontal plane would hardly occur. Whereas, in the Gladyshev method (the method (3) above) in the prior art, an entire orbit of the incident ion beam exists in a magnetic field having a gradient perpendicular to a traveling direction, hence the aforementioned condition for convergence cannot be fulfilled, and divergence of the incident ion beam from an incident orbit would increase after every one round. Also, the method of offsetting a magnetic field by an electric field (the method (2) above) practised in the Saclay Research Laboratory is called "velocity selection method", in which a diverging power in the horizontal directions for an incident ion beam is inherently large, hence it is used for detection of a slight mass difference between isotope elements or the like, but it is difficult to transmit a large-intensity incident ion beam through that method.

In addition, in the external ion injection apparatus according to the present invention, with regard to convergence in the vertical direction also there exists no problem because the acceleration and deceleration by the beam guiding electrode group 14 always has a vertical converging power. This converging effect is called "unipotential lens effect", and it is widely utilized in an electron microscope, an accelerator, etc. Rather, it may be necessary to adjust the magnetic field by giving a small gradient thereto or to regulate the distance d because the converging effect is too strong. Comparing now the injecting apparatus according to the present invention with other injecting methods, the Gladyshev method has a relatively weak vertical converging power. In addition, the velocity selection method necessitates a separate converging lens, and it is difficult to accommodate these lenses within a narrow magnetic pole gap. Accordingly, the external ion injection apparatus according to the present invention is superior to these prior art methods.

In summary, in the external ion injection apparatus according to the present invention, since the incident ion beam would reach the central portion of the magnetic poles along the repeated semicircle orbit 15 having an orbit radius corresponding to its energy, it can reach the central portion of the magnetic poles through a far smaller orbit distance than that in the Gladyshev method in which the ion beam moves towards the central portion of the magnetic poles a little by a little along a boundary between a hill and a valley of a magnetic field depending upon a difference of an orbit radius, hence the problems of conversion of electric charge due to a residual gas and scattering would not arise so often, and further, since the converging effects in the horizontal and vertical directions are present, transmission of a large-intensity incident ion beam is possible.

In addition, with the external ion injection apparatus according to the present invention, like every other external ion injection method, a degree of vacuum within a cyclotron would not be deteriorated by an ion source gas, and further, the external ion injection apparatus according to the present invention is superior to the vertical injection method in the prior art in which an ion beam passes through a hardly evacuatable hole at the center of the magnetic pole. Also, the external ion injection apparatus according to the present invention does not necessitate to drill a hole at the center of an electromagnet, to calculate a three-dimensional behavior of the incident ion beam under the influence of the electromagnet, and to produce an inflector having a complex configuration. And the external ion injection apparatus according to the present invention can be applied to a cyclotron manufactured already as a standard product.

In the external ion injection apparatus according to the present invention, as a numerical limit the above-described incident voltage is defined, and the numerical value amounts to about 50–150 kV, although it depends upon the size of the magnetic pole gap. This value is 5–10 times as large as the numerical value employed in the perpendicular injection method, and so, the present invention is advantageous for transmission of a low-energy incident ion beam.

Furthermore, in the external ion injection apparatus according to the present invention, the above-mentioned limits are present for the values of the distances $h_2$ and d. The distance $h_2$ is determined depending upon the vertical amplitude of the acceleration orbit 18 within the cyclotron. In other words, it could be chosen smaller than the slit width of the dummy dee 16. With regard to the value of the distance d, there is no need to worry about that value because with respect to electric discharge, discharge perpendicular to the magnetic field would hardly occur. Rather, the effect of the beam guiding electrode group 14 is determined depending upon the ratio of the distance d to the distance $h_1$ as described above, and so the lower limit is determined by the effect.

It is to be noted that the above-described embodiment is no more than one example of the mode of embodying the present invention, and as a matter of course, various modifications thereof are possible. For example, while the case where the dee is provided one was illustrated in connection to the above-described embodiment, it could be provided in multiple. In addition, although the beam guiding electrode group is arranged at right angles to the dummy dee in the above-described embodiment, it is a matter of course that other arrangements could be employed.

As will be apparent from the above description, according to the present invention, since there is no need to dispose an ion source at the central portion of the magnetic poles as is the case with the cyclotron in the prior art, the interior of the cyclotron can be maintained at a high degree of vacuum. As a result, even the ions liable to change in electric charge such as negative ions or heavy ions would not be subjected to change of electric charge, and acceleration of a large-intensity ion beam is possible. Moreover, since a degree of vacuum is high and electric discharge would hardly occur, it is also possible to use a high dee voltage. Since a large-intensity negative ion source is generally large in size, it could not be assembled within a small-sized cyclotron, but according to the present invention, as an ion source is placed outside of the cyclotron, acceleration of negative ions has become possible even by means of a small-sized cyclotron. In addition, according to the present invention, as an ion beam having a constant property is driven from the outside, loss of an ion beam can be suppressed to minimum, and an amount of radio-active contamination of a cyclotron becomes low. In addition, the efficiency of taking out an ion beam by means of a deflector is also improved. Furthermore, as the ion source is provided externally of the cyclotron, maintenance of the ion source also would become easy. Also, replacement of a filament and other parts becomes easy, and prevention and compensation for changes of properties of the accelerated ion beam caused by changes of properties of the ion source during operation, are easier than in the apparatus having an ion source provided within a cyclotron. Among the maintenance work for a cyclotron, the work associated with a large probability of irradiation of a worker is replacement of a deflector septum, but in the case of negative ions the deflector becomes unnecessary owing to the use of a stripper, and since the replacement and supplement of a stripper can be finished with a short period of time, a dose of irradiation for an operator and a maintenance worker can be reduced. For the other persons entering an accelerator room as occasion calls, also the problem of irradiation can be mitigated.

While a principle of the present invention has been described above in connection to a preferred embodiment of the invention, it is intended that all matter contained in the above description and illustrated in the accompanying drawings shall be interpreted to be illustrative and not in a limiting sense.

What is claimed is:

1. An apparatus for externally injecting ions into a cyclotron, said cyclotron comprising a pair of magnetic poles for generating a magnetic field, said cyclotron having a magnetic midplane between said magnetic poles, said magnetic midplane including a central portion, said cyclotron having an outer circumferential edge, wherein the improvement comprises:

ion producing means disposed externally of said cyclotron for producing said ions;

first D.C. high voltage generating means coupled to said ion producing means for generating a first D.C. high voltage having a first polarity to be used for injecting said ions as an incident ion beam with a predetermined acceleration into said cyclotron along said magnetic midplane;

second D.C. high voltage generating means for generating a second D.C. high voltage having a second polarity the same as said first polarity; and leading means arranged within said cyclotron and supplied with said second D.C. high voltage for leading said incident ion beam toward said central portion along a repeated semicircle orbit, said leading means continuously extending in a straight line between said outer circumferential edge and said central portion.

2. An apparatus as claimed in claim 1, wherein said leading means consists of a combination of repeller electrodes supplied with said second D.C. high voltage for generating an electric field to decelerate or accelerate said incident ion beam, and earth electrodes disposed closely to said repeller electrodes for limiting a range of said electric field.

3. An apparatus as claimed in claim 2, wherein said repeller electrodes are arranged as separated by a first distance from each other via said magnetic midplane, said earth electrodes being arranged as opposed to each other with said repeller electrodes placed therebetween and as separated by a second distance from each other via said magnetic midplane.

4. An apparatus as claimed in claim 3, wherein said first distance is longer than said second distance.

* * * * *